US005326188A

United States Patent [19]

Bowman

[11] Patent Number: 5,326,188

[45] Date of Patent: Jul. 5, 1994

[54] ANCHOR FOR MANHOLE COVER SUPPORT

[76] Inventor: Harold M. Bowman, 18867 N. Valley Dr., Fairview Park, Ohio 44126

[21] Appl. No.: 986,980

[22] Filed: Dec. 8, 1992

[51] Int. Cl.[5] ..... E02D 29/14

[52] U.S. Cl. ..... 404/25; 404/26; 292/256.71

[58] Field of Search ..... 404/25, 26; 52/20, 21; 292/256.71, DIG. 39; 49/465; 220/324, 325, 328, 327, 352

[56] References Cited

U.S. PATENT DOCUMENTS

| | | | |
|---|---|---|---|
| 706,642 | 8/1902 | Dods | 292/256.71 |
| 3,410,447 | 11/1966 | McFarland | 220/325 |
| 3,773,428 | 11/1973 | Bowman | 404/26 |
| 4,281,944 | 8/1981 | Bowman | 404/26 |
| 4,867,601 | 9/1989 | Bowman | 404/26 |
| 4,969,770 | 11/1990 | Bowman | 404/26 |
| 5,039,248 | 8/1991 | Bowman | 404/26 |

*Primary Examiner*—Ramon S. Britts
*Assistant Examiner*—Pamela A. O'Connor
*Attorney, Agent, or Firm*—Watts, Hoffmann, Fisher & Heinke

[57] ABSTRACT

An anchor for securing a manhole cover support to a manhole frame is shown. Dovetail-shaped receptacles are formed at a plurality of locations about the manhole cover support. A plurality of anchor straps having a cooperating dovetail shape are inserted into the receptacles. A lower end of each anchor strap has a threaded bolt extending upward. The anchor straps are simply dropped into the receptacles and the lower bolt is rotated to wedge the dovetail shapes tightly together and, at the same time, secure the manhole cover support against the frame.

7 Claims, 4 Drawing Sheets

ANCHOR FOR MANHOLE COVER SUPPORT

BACKGROUND OF THE INVENTION

1. Field of the Invention

This invention relates to manhole cover supports for placing over and raising the effective grade of an existing manhole cover-receiving structure, and more particularly, to anchors for anchoring manhole cover supports to manhole cover-receiving structures.

2. Description of the Related Art

Ordinarily, a manhole cover support is used when a roadway is resurfaced with an added layer of paving material. A manhole cover support raises the level of the manhole cover to the new street level. Frequently, manhole cover supports are anchored to the manhole frame. A typical prior art anchor is simply a strap of metal which is bolted to a threaded hole in the manhole cover support at its upper end. The lower end is angled to reach beneath a flange which is formed in the manhole frame. A bolt which is threaded through the lower end of this strap contacts the underside of the flange to tighten the anchor. In other words, when the bolt is rotated, the strap is pulled downward to anchor the manhole cover support to the frame.

Installation of the prior art anchor straps requires that a worker hold the strap in position with one hand, and thread the upper screw into the manhole cover support with the other. Often times, the bolt and/or the strap and/or the wrench are dropped into the sewer pipe below. There is a need for a simple, speedy positive means of connecting the anchor straps with the manhole cover support to simplify installation and reduce the frequency of dropping parts.

Another problem utility companies face is that some manhole covers have downwardly extending reinforcement members on their underside. These reinforcement members sometimes interfere with conventional anchor straps and prevent their use. To replace the manhole cover with another non-interfering type is often prohibitively expensive. Thus, there is a need for a locking device which avoids interference with this type of manhole cover.

SUMMARY OF THE INVENTION

Basically, the invention is a manhole cover support adapted to mount to a manhole frame, such frame including a manhole and a flange surrounding said manhole. The manhole cover support has an inner rim portion that surrounds and defines a central opening and a locking arrangement including at least one receptacle formed in the rim portion. The receptacle is open in the upward direction for slidably receiving a cooperatively shaped head of a locking arm which is constructed to engage the flange and lock the cover support to the frame. The receptacle has a stop arrangement for limiting the downward travel of the locking arm.

BRIEF DESCRIPTION OF THE DRAWINGS

Preferred embodiments of the invention are shown in the accompanying drawings in which.

DESCRIPTION OF THE PREFERRED EMBODIMENTS

Figure 1:
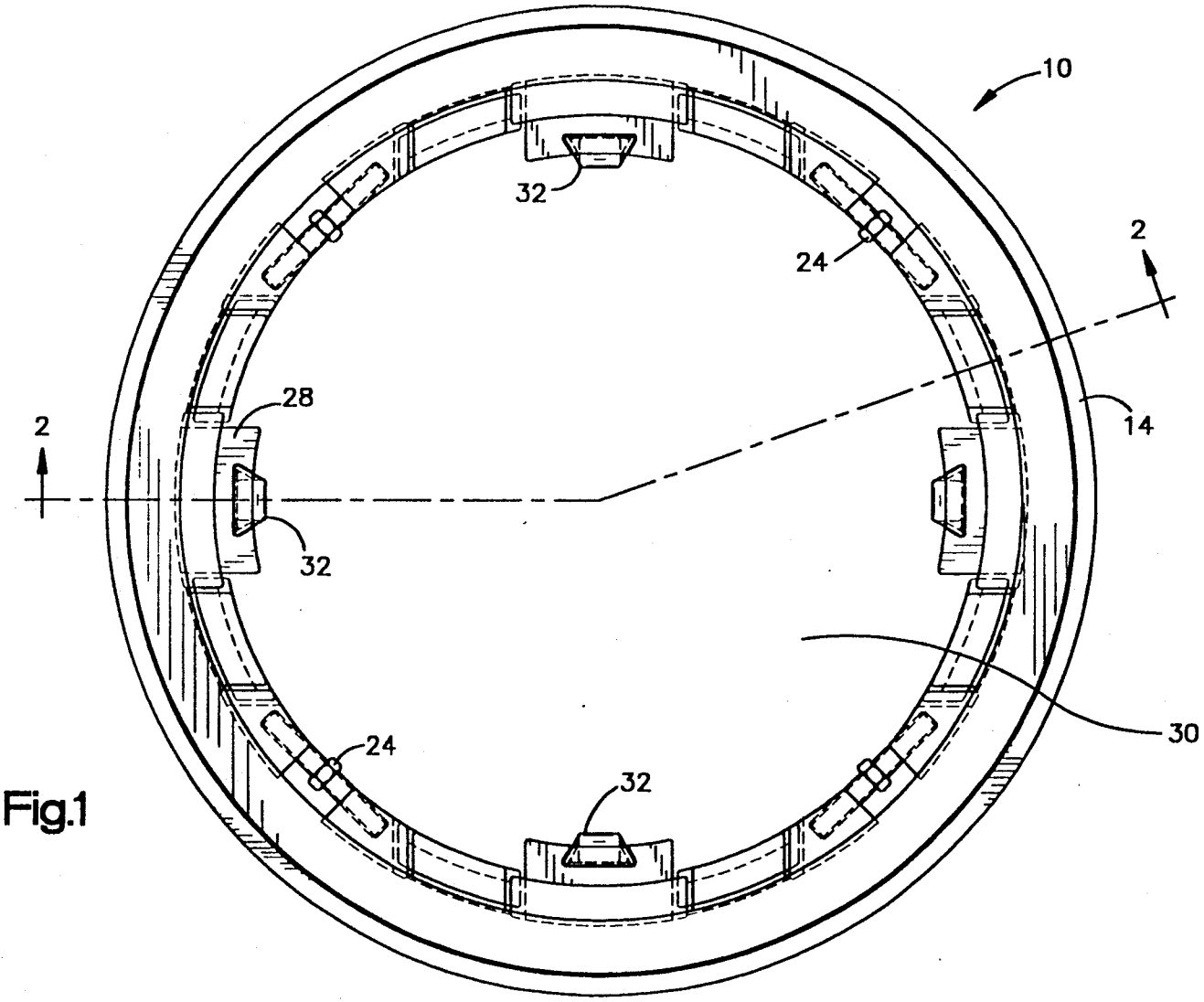
FIG. 1 is a top plan view of a manhole cover support and an anchoring system.
Figure 2:
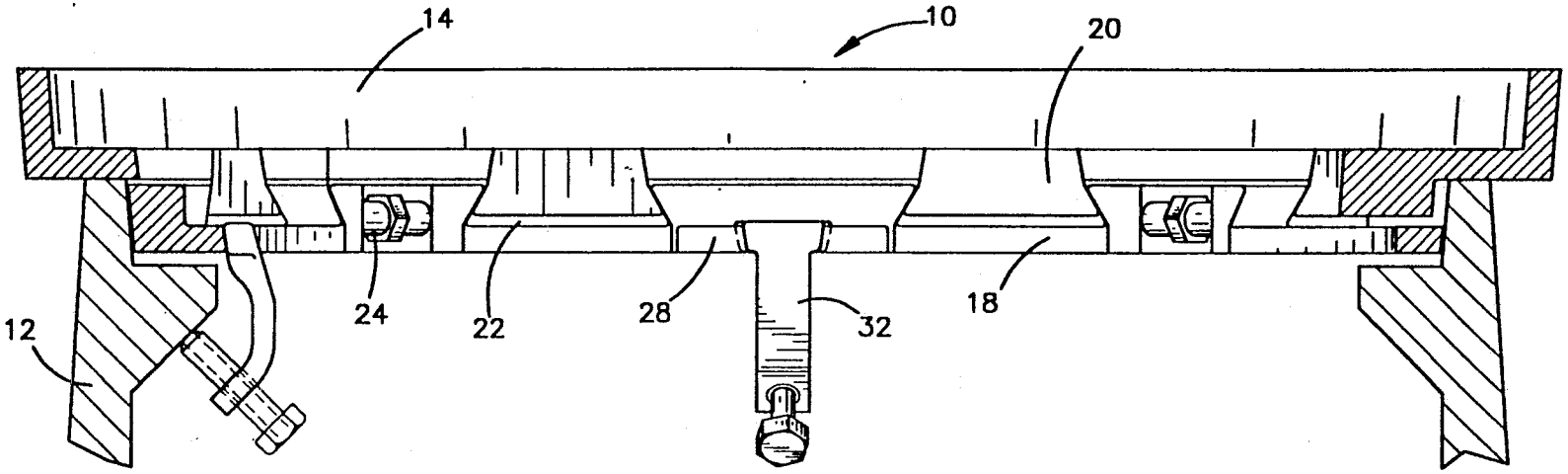
FIG. 2 is a cross-sectional view as seen approximately from the plane indicated by the line 2—2 in FIG. 1.
Figure 2A:
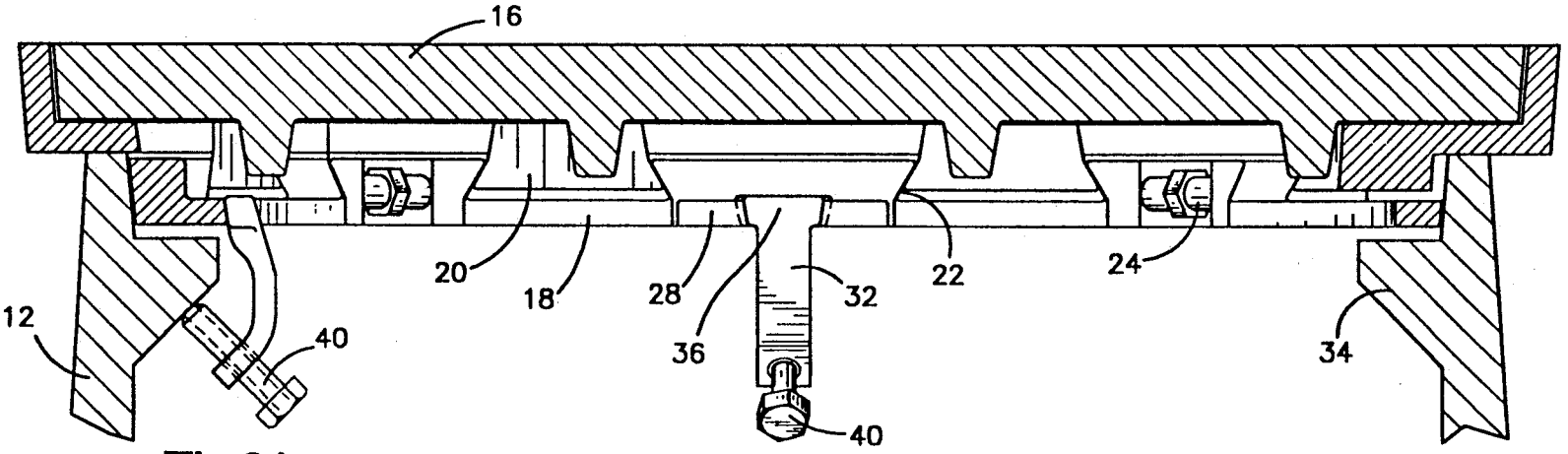
FIG. 2A is a side elevational view like FIG. 2 with the addition of a manhole cover.

Referring to FIGS. 1, 2 and 2A, a manhole cover support 10 is shown mounted on a manhole frame 12. The cover support 10 is similar to that disclosed in U.S. Pat. No. 4,969,770 which is incorporated herein by reference. The manhole cover support 10 includes a top ring 14 for receiving a manhole cover 16 and a base ring 18 for seating in the manhole frame 12. A plurality of dovetail-shaped lugs 20 formed in the upper ring engage with dovetail-shaped slots formed in the base ring to interlock the top ring 14 with the base ring. The base ring 18 is formed of a plurality of like segments (FIGS. 6 and 7) which are adjoined by threaded turnbuckle bolts 24. During installation, the turnbuckles expand the diameter of the base ring to fit tightly within the seat of the manhole frame 12.

Figure 3:
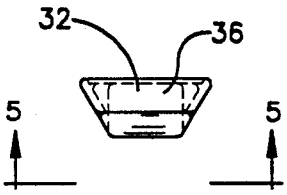
FIG. 3 is a top plan view of one preferred type of anchor strap.
Figure 4:
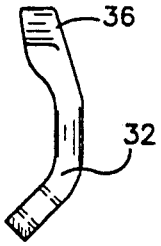
FIG. 4 is a side elevational view of the anchor strap of FIG. 3.
Figure 5:
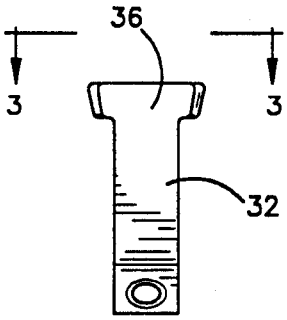
FIG. 5 is a front view of the anchor strap of FIG. 3 as seen approximately from the plane indicated by the line 5—5 in FIG. 3.

The locking arrangement for locking the manhole cover support 10 to the frame 12 includes a plurality of dovetail-shaped receptacles 26 formed in an inner rim portion 28 of the base ring 18. The inner rim portion 28 surrounds and defines the central opening 30 through which a man passes when entering the manhole frame 12. A plurality of locking arms 32 (FIGS. 3–5) are constructed to fit within the receptacles 26 and to engage a flange 34 on the frame 12 for locking the cover support 10 to the frame 12.

Figure 6:
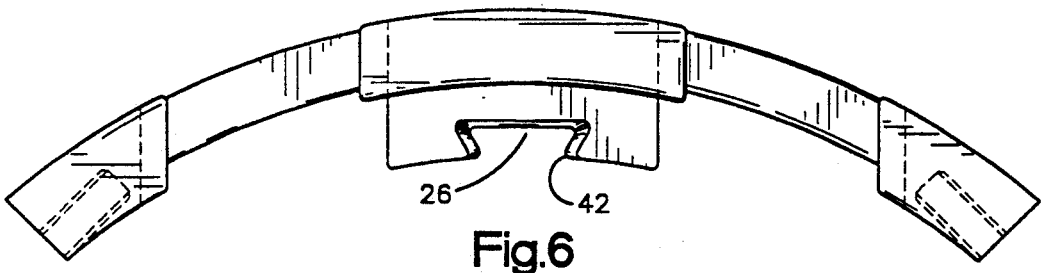
FIG. 6 is a top plan view of a section of the manhole cover support of FIG. 1.
Figure 7:
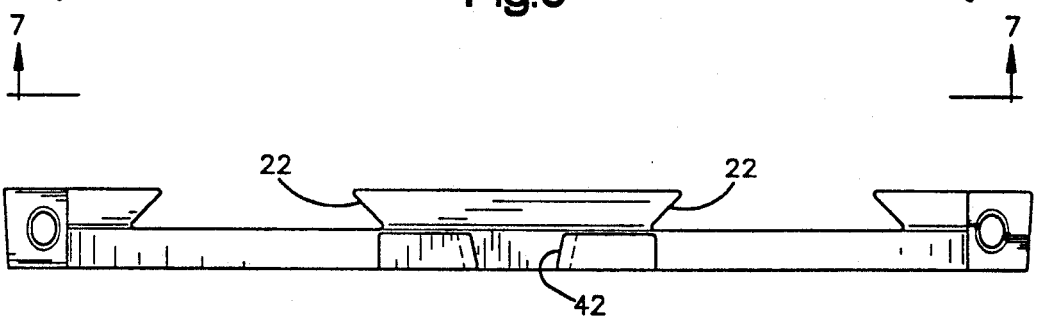
FIG. 7 is a front elevational view as seen approximately from the plane indicated by the line 7—7 of FIG. 6.

As illustrated in FIG. 6, each receptacle 26 has a wedge-shaped or tapered inner shape and an upwardly facing opening. The receptacles 26 narrow in the downward direction as seen in FIG. 7. Also, the receptacles 26 are tapered such that they narrow in the direction of the center axes of the manhole opening 30 as best seen in FIGS. 1 and 6. Each locking arm 32 has a head portion 36 which is dovetail-shaped to cooperate with the receptacles 26. One end of each locking arm 32 includes a threaded hole 38 for receiving a bolt 40. The receptacles 26 have a vertically extending opening 42 on a side facing the center axis of the manhole 30 which allows the arm to extend outward from the receptacle 26. However, the opening 42 is restricted to prevent the larger head portion 36 from escaping from the receptacle 26.

During installation, the locking arms are lowered into the receptacles from above the base ring with the threaded bolt downward as illustrated in FIG. 2. The head slides downward until the taper fit between the arms 32 and the receptacles 26 stops further downward movement. Then, the bolt 40 is tightened to produce tension in the arm, thus pulling the manhole cover support 10 downward.

Figure 8:
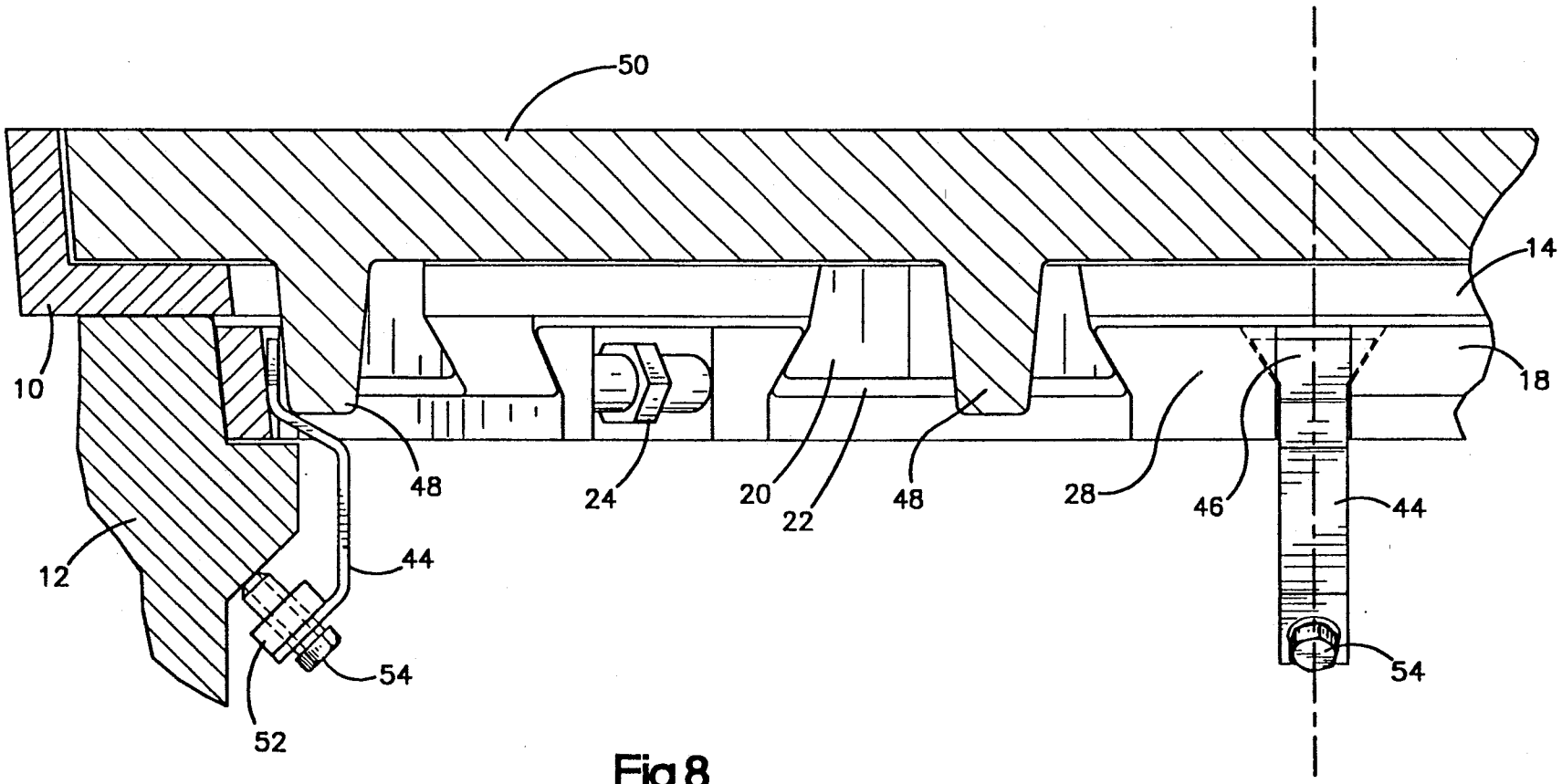
FIG. 8 is a cross sectional view of a second embodiment showing a thin anchor strap.

In a second embodiment shown in FIG. 8, a thin locking arm 44 is shown. The thin locking arm is shaped much like the locking arms 32 in that each has a dovetail-shaped head 46. However, the thin arms 44 are stamped of relatively thin sheet metal. As seen in FIG. 8, the thin metal body of the arm 44 allows locking arms to be used where a bulkier cast locking arm would interfere with reinforcement members 48 extending downward from a manhole cover 50. A threaded block 52 is welded to the lower portion of each arm 44 for receiving a threaded bolt 54. The arm 44 is adapted to fit into the receptacles 26 described above and are installed in the same manner as the previously described east arms 32. FIG. 8 illustrates how the thin arms 44 avoid interference with the members 48 by fitting within the narrow clearance between the member 48 and the base ring 18.

While preferred embodiments of this invention have been described in detail, it will be apparent that certain modifications or alterations can be made without departing from the spirit and scope of the invention set forth in the appended claims.

I claim:

1. A manhole cover support adapted to mount to a manhole frame, such frame including a manhole having a central axis and a flange surrounding said manhole, said manhole cover support having an inner rim portion that surrounds and defines a central opening, said cover support having locking means including at least one receptacle formed in said rim portion and at least one locking arm which is constructed to engage said flange and lock said cover support to said frame, said receptacle being open in the upward direction for slidably receiving a cooperatively shaped head of said locking arm, said receptacle having a stop means for limiting the downward travel of said locking arm wherein said locking arm is separable from said receptacle when disengaged with said flange by sliding said locking arm axially of said manhole away from said stop means.

2. A manhole cover support according to claim 1 wherein said stop means is a taper formed in said receptacle such that said receptacle narrows in the downward direction.

3. A manhole cover support according to claim 1 wherein a vertically extending opening is formed in said receptacle facing the direction of the center axis of said manhole and wherein said opening has a restricted width to prevent said cooperatively shaped portion from exiting said receptacle in the direction of said center axis.

4. A manhole cover support according to claim 1 wherein said receptacle is tapered such that it narrows towards the direction of said center axis.

5. A manhole cover support for supporting a manhole cover on a manhole of a manhole frame, said manhole having a center axis and said frame having an inner flange, said cover support comprising:

a base member adapted to seat in a manhole frame, said base member having a frame-engaging surface for engaging said frame, a cover-receiving surface for receiving said cover, and an inner rim portion defining an access opening to said frame and having a plurality of receptacles formed therein, each having an upwardly facing opening for slidably receiving a cooperatively shaped head of a locking arm, said arm having a portion for engaging an underside of said flange for locking said cover support to said frame, each receptacle having stop means for limiting the downward travel of said locking arms wherein said locking arm is separable from said receptacle when disengaged with said flange by sliding said locking arm axially of said manhole away from said stop means.

6. A locking means for securing a manhole cover support to a manhole frame having an inner flange, said locking means including:

a base member adapted to seat in said manhole frame, said base member having a frame-engaging surface for engaging said frame, a cover-receiving surface for receiving said cover, and an inner rim portion defining an access opening to said frame and having a plurality of wedge-shaped receptacles formed therein, each for receiving a locking arm for locking said cover support to said frame, each of said arms including:

a wedge-shaped head for cooperatively engaging one of said wedge-shaped receptacles;

a frame engaging portion for engaging an underside of said inner flange; and a tensioning means for tensioning each said locking arm to secure said base member to said frame wherein tension in said locking arms causes said heads to wedge against said receptacles; and wherein said wedge-shaped heads and cooperating receptacles permit the locking arms to be removed from said base member when said locking arms are disengaged with said frame.

7. A locking means according to claim 6 wherein said receptacles have an upwardly facing opening for receiving said head from above said rim.

* * * * *